US008276548B2

(12) United States Patent
Consadori et al.

(10) Patent No.: US 8,276,548 B2
(45) Date of Patent: Oct. 2, 2012

(54) LOW COST TANKLESS PORTABLE WATER HEATER

(75) Inventors: Franco Consadori, San Clemente, CA (US); Gerald Rennert, Phoenix, AZ (US); Ryan Chavez, Capistrano Beach, CA (US)

(73) Assignee: Girard Systems, San Clemente, CA (US)

( * ) Notice: Subject to any disclaimer, the term of this patent is extended or adjusted under 35 U.S.C. 154(b) by 609 days.

(21) Appl. No.: 12/478,657

(22) Filed: Jun. 4, 2009

(65) Prior Publication Data

US 2010/0031900 A1 Feb. 11, 2010

Related U.S. Application Data

(60) Provisional application No. 61/087,115, filed on Aug. 7, 2008.

(51) Int. Cl.
*F24H 1/00* (2006.01)

(52) U.S. Cl. ..... 122/18.1; 251/129.15

(58) Field of Classification Search ..... 122/18.1; 251/129.15

See application file for complete search history.

(56) References Cited

U.S. PATENT DOCUMENTS 5,039,007 A 8/1991 Wolter
5,881,681 A * 3/1999 Stuart ..... 122/18.31

FOREIGN PATENT DOCUMENTS

JP 2006112763 A * 4/2006

OTHER PUBLICATIONS

Tagaki, T-Kjy Instantaneous water heater, Apr. 2007, pp. 1-29, http://web.archive.org/web/20070418101109/http:takagi.com/web2003/c03.htm.*

* cited by examiner

*Primary Examiner* — Gregory A Wilson
(74) *Attorney, Agent, or Firm* — Walter A. Hackler

(57) ABSTRACT

A portable tankless water heater includes a heat exchanger disposed in a sealed housing with an inlet cold water line and an outlet hot water line extending outside the sealed housing. A burner, disposed in an operative relationship with said heat exchanger is provided for heating water flowing through said heat exchanger and an exhaust system induces draft of air from a housing air inlet through said heat exchanger and out of a housing flue outlet.

10 Claims, 3 Drawing Sheets

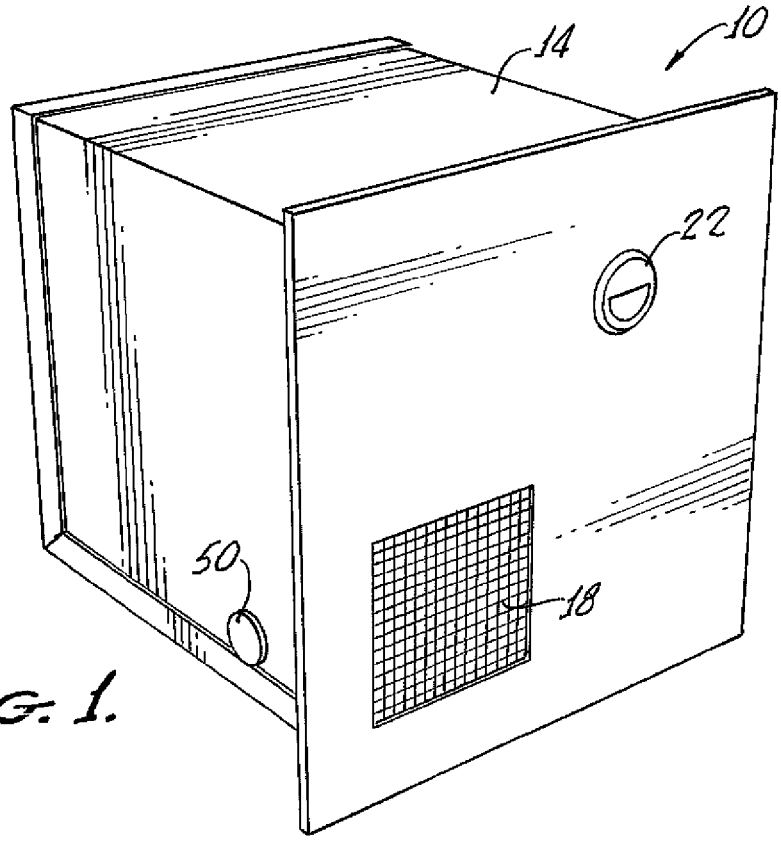
FIG. 1.
FIG. 2.
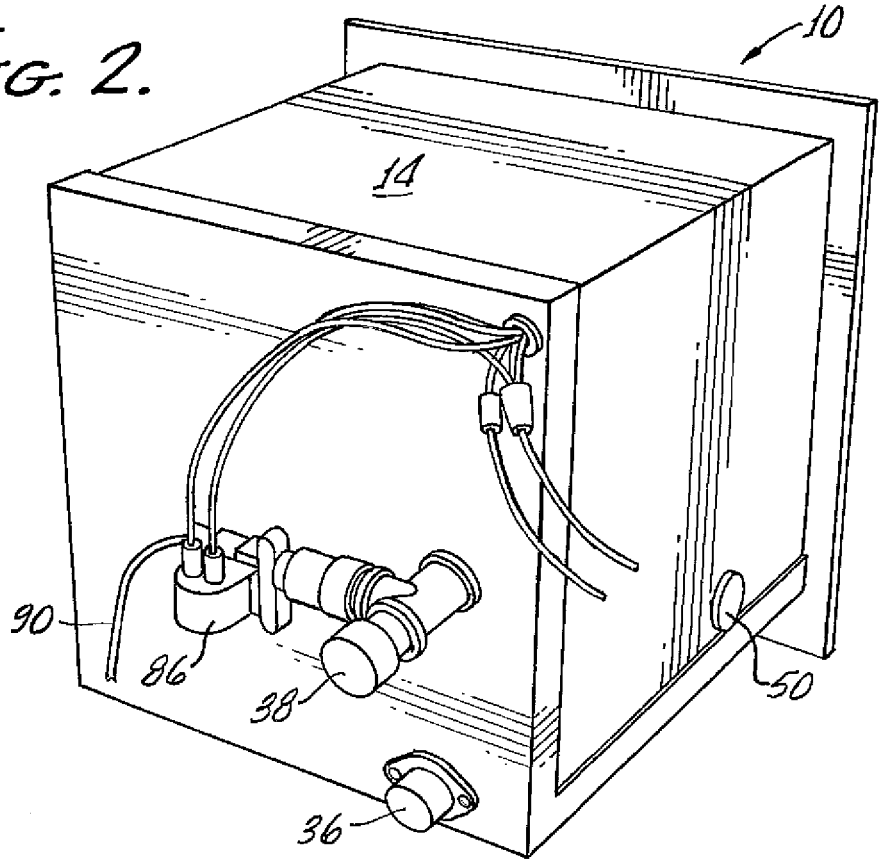

FIG. 3.
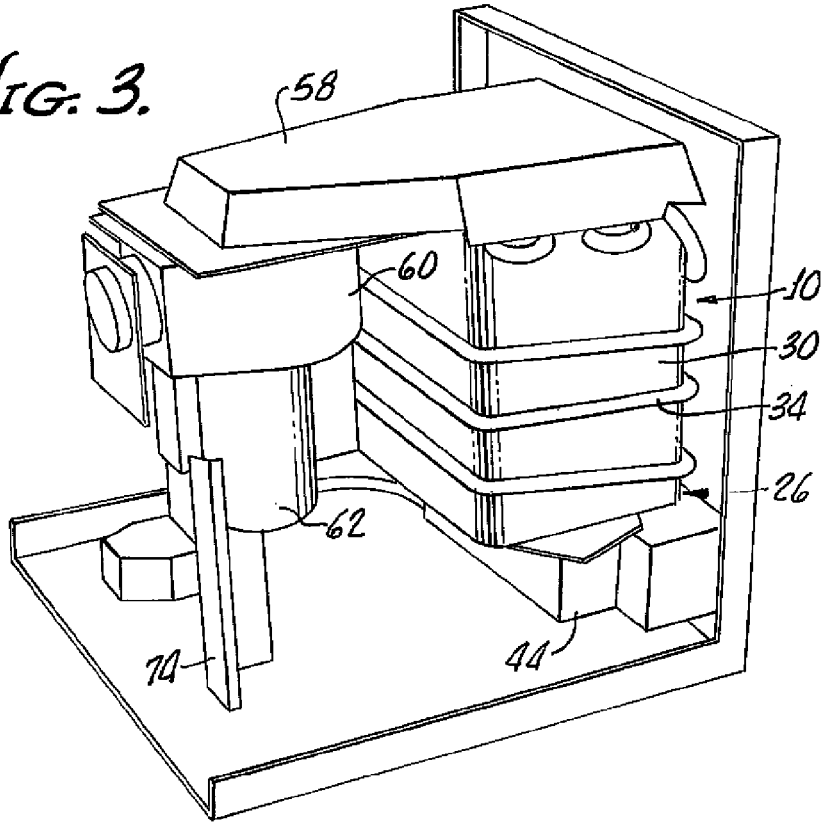
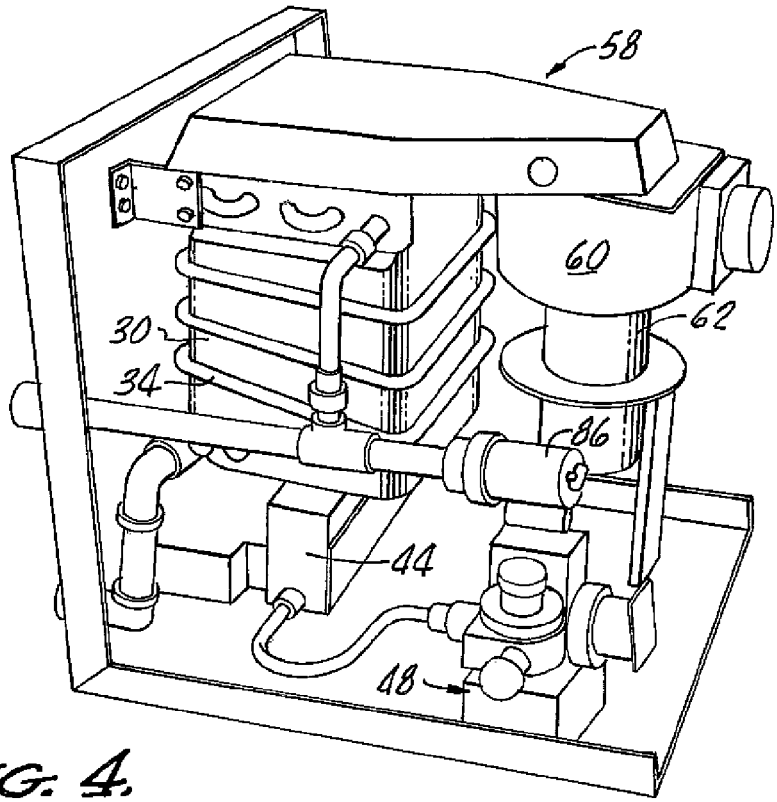
FIG. 4.

LOW COST TANKLESS PORTABLE WATER HEATER

This application claims priority from provisional application Ser. No. 61/087,115 filed Aug. 7, 2008.

The present invention generally relates to gas fired tankless water heaters and is more specifically directed for tankless water heaters for use in recreational vehicles or, utility vehicles, and boats. Such utility vehicles includes ambulances, fire trucks, military vehicles where hot water is required for certain procedures.

Conventional tankless water heaters designed for the home or commercial buildings are typically the large, heavy, and may run at high temperatures requiring a special mounting fixtures and safety devices. For these reasons, such conventional tankless water heaters are obviously not portable and not suitable for use in recreational vehicles and boats.

Because space is at a premium in recreational vehicles and boats, hot water heaters utilizing tanks are not desirable, but are today universally used notwithstanding their weight and bulky configuration. A typical unit includes a tank that provides 5 to 10 gallons of hot water with recovery times ranging from 30 to 60 minutes.

Portable hot water heaters such as described in U.S. Pat. No. 5,039,007 which provide for both hot water and heated air for space heating purposes have never been developed commercially. Currently there is a only one gas fired tankless water heater for recreational vehicles and boats on the US market which has gained very limited acceptance (Less than 5% of the market) due to its high cost and poor performance. The main reasons of its low performance and high cost are:

a. The gravity combustion flue design that often results in condensation conditions that limits its efficiency and results in poor wind resistance with consequent flame-outs in many camping conditions.
b. The absence of a post burn purge that results in unnecessary stressing of heat exchanger and flue duct parts when residual heat causes these components to be subjected to high temperatures for long periods of time.
c. An expensive gas modulation valve and with microprocessor control to maintain a constant water temperature output: this is an unnecessary feature and its declared purpose (anti-scalding function) can be provided at much less cost and higher reliability.
d. Absence of a practical anti-freezing capability. An electrical heater, supplied for this purpose, can only be used when an AC electrical power source is available: this severely limits the use of the unit in the winter.

Because of the problems inherently associated with the hereinabove described water heaters, there is a need for a portable, small, lightweight, gas fired tankless water heater capable of being mounted in a recreational vehicle or boat while being totally sealed therefrom with regard to combustion and gases yet having a high efficiency. The present invention fills that need.

SUMMARY OF THE INVENTION

A portable gas fired tankless hot water heater in accordance with the present invention generally is designed to be mounted in a small compartment on the outside of the vehicle and consists of a sealed housing having air inlet and a flue outlet along with a heat exchanger disposed in the sealed housing with a gas connection, an inlet cold water line and an outlet hot water line extending outside the sealed housing into the vehicle.

Burner apparatus, including a burner, is disposed in an operative relationship with the heat exchanger for heating water flowing through the heat exchanger.

Further, blower apparatus is provided for inducing draft of air from the air inlet through the heat exchanger and out of the flue outlet. This introduced draft greatly enhances the combustion efficiency of the water heater and eliminates condensing conditions by providing a large supply of combustion air while extracting any excess water vapor whenever the efficiency approaches 100%. The induced draft design makes the design impervious to loss of flame caused by high wind conditions and while traveling.

An electronic direct spark ignition board and a Gas Regulator with an automatically controlled Dual Solenoid shut-off valve are provided for operating the burner apparatus according to the requirements of the ANSI Z21.10.3 safety standard.

To further enhance the efficiency and safety of the water heater, the burner apparatus further includes an additional solenoid valve for enabling the burner to operate at two different BTU levels at different water flow rates. By reducing the BTU level whenever the output temperature reaches a preset limit value, gas fired tankless water heater in accordance with the present invention maintains the output temperature between acceptable limits to avoid scalding the users. This feature is achieved using a low cost metal disc thermostat to directly activate the Dual BTU valve without the need of an expensive microprocessor control.

A second metal disc thermometer is used to automatically shut off the burner in case of failure of any component that may result in a runaway combustion situation. This is a mandatory safety feature often referred to as a Limit Switch.

An additional safety feature is achieved by incorporating a Relay and a metal disc thermostat on the exhaust housing that cause the induced draft blower to remain operating after each burn until the exhaust housing reaches a low temperature, thus eliminating thermal stress on the heat exchanger and exhaust components.

A safety feature of last resort of the heater in accordance with the present invention includes a fuse link sensor disposed exterior to the heat exchanger and interconnected with the ignition board for determining blockage of draft through the detection of flames outside the heat exchanger in which case the power to the ignition board is interrupted resulting in immediate shut off of the burner upon determination of draft air blockage.

In order to enable use of the hot water heater in accordance with the present invention, in cold climates, an anti-freezing thermostat switch may be disposed in the outlet hot water line and a solenoid valve may be connected to both of the anti-freeze thermostat switch and the outlet hot water for drawing water from the output hot water line upon receipt of the signal from the anti-freeze thermostatic switch. Thus, as hereinafter described, when the temperature of the water and the outlet hot water line reaches a preselected temperature above freezing, the burner turns on and overflow water is either disposed of exterior to the recreational vehicle or boat, or recycled.

BRIEF DESCRIPTION OF THE DRAWINGS

The advantages and features of the present invention will be better understood by the following description when considered in conjunction with the accompanying drawings in which:

FIG. 1 is a perspective view of a heater in accordance with the present invention showing a front, side, and top of a sealed housing with an air inlet and a flue outlet on a front panel;

FIG. 2 is a perspective view of the heater shown in FIG. 1 showing a back and side panel with an inlet cold water line and a outlet hot water line through the back panel and a gas line through the side panel;

FIG. 3 is a perspective view of the heater shown in FIGS. 1 and 2 with side panels removed and generally showing a burner apparatus and heat exchanger;

FIG. 4 is another perspective view of the heater shown in FIGS. 1-3 further showing a gas regulation and interconnecting lines.

DETAILED DESCRIPTION

Figure 5:
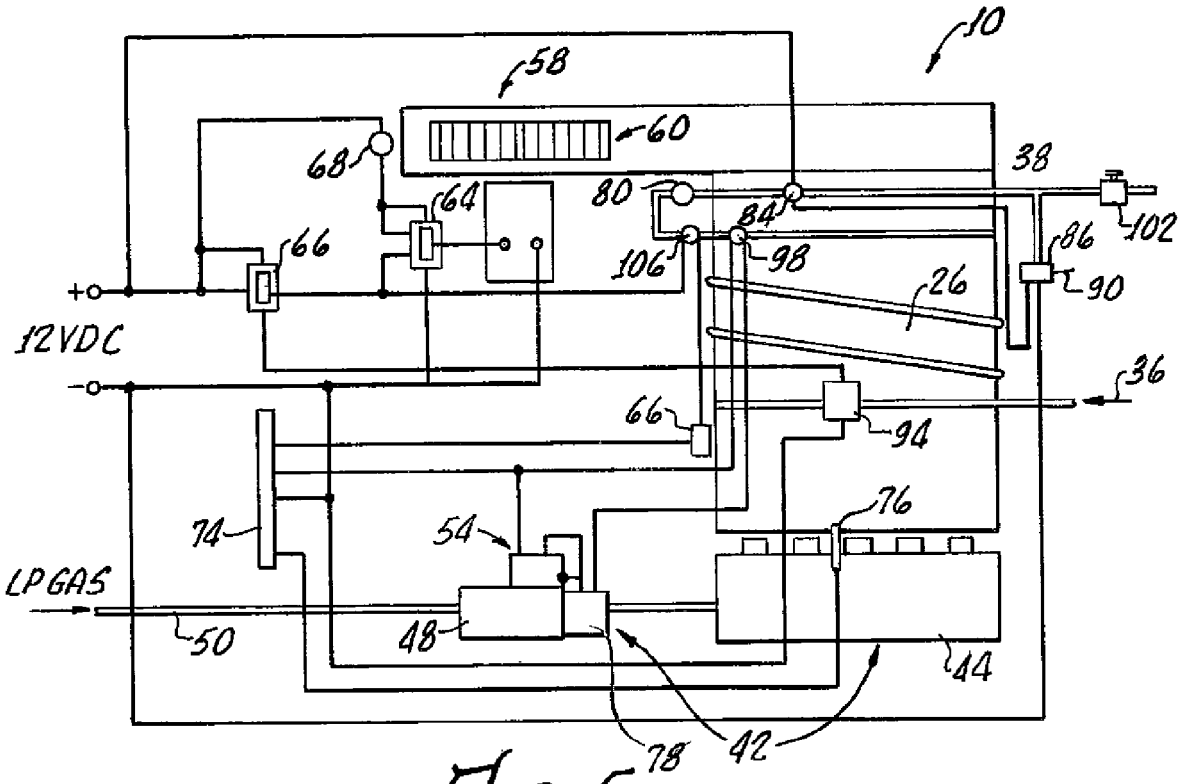
FIG. 5 is a functional diagram of the heater shown in FIGS. 1-4.

With reference to FIGS. 1-5, a portable tankless water heater 10 in accordance with the present invention includes a sealed housing 14, fabricated from any suitable material such as metal, which includes an air inlet 18 and a flue outlet 22.

A heat exchanger 26 includes a plenum 30 with surround tubing 34 connected to a cold-water inlet 36 and a hot water outlet 38. As shown in FIG. 2, the cold-water inlet 36 and hot water outlet 38 extend outside of the sealed housing 14.

Burner apparatus 42 includes a burner 44 which is disposed in an operative relationship with the heat exchanger 26 for heating water flowing through the tubing 34.

The burner apparatus 42 further includes a gas regulator 48 connected to the gas line 50 which extends outside of the sealed housing 14 along with dual solenoid valves 54 for enabling the burner 44 to operate safely under the control of a direct spark ignition board 74 with a set of two valves for redundancy. The direct spark ignition board 74 also monitors the flame of the burner 44 verifying the presence of ionization at the location of a spark igniter 76 and promptly shuts off the gas flow by means of the dual solenoid valves 54.

Gas regulator 48 incorporates an additional solenoid valve 78 (See FIG. 5). That activates the Dual BTU function providing the High BTU output when the solenoid Valve is open (activated) and the Low BTU output when no power is applied.

The burner 44, regulator 48, and solenoid valves 54 are conventional and are available from several domestic and foreign suppliers for use in traditional gas appliances. (Honeywell, United Technologies, White Rogers (Emerson), Seven Universe (Taiwan), SIT (Italy) we are currently using Seven Universe Model# BZB02A0502 with Dual BTU option.

An exhaust system 58, including a blower 60 with blower motor 62, blower relay 64, ignition relay 66, and time delay switch 68 (See FIG. 5), is provided for inducing draft of air from the air inlet 18 through the heat exchanger 26 and out of the flue outlet 22. This greatly enhances the efficiency of the burner 44 heat exchanger 26, and as hereinbefore noted, provides the performance advantages relating to condensation materials stressing and wind resistance.

With continued reference to FIG. 5, ignition board 74 with a spark igniter 76, which may be of any approved conventional design certified by an appropriate agency (i.e. CSA, UL or other), is provided for operating the burner apparatus 42 and the exhaust system 58.

A sensor 66 disposed exterior to the heat exchanger 26 is provided for determining blockage of draft air through detection of flames outside of the heat exchanger 26 and is interconnected with the ignition board 62 which is configured for stopping the burner 44 upon determination of draft air blockage in the heat exchanger 26.

In addition, a conventional approved pressure/temperature relief valve 80 is provided in the hot water line to provide pressure relief in case of overheating in the hot water line 38 in a conventional manner.

For winter operation, an anti-freeze thermostatic switch 84 is disposed in the outlet hot water line 38 and a solenoid valve 86, connected to both the anti-freeze thermostat switch 84 and outlet hot water line 38, provides for drawing water from the hot water outlet line 38 upon receipt of the signal from the anti-freeze thermostatic switch which is configured for providing a signal at a preselected temperature. Such anti-freezing thermostatic switches are available from Thermo-Disc, Klixon, Cantherm and other approved suppliers.

Preferably, the solenoid valve 86 is disposed outside the housing 14 and diverts water through a drain line 90 to the environment or to a recycle tank (not shown). Thus, when a low temperature is sensed by the valve 80 and a solenoid valve 86 is opened water is drawn from the hot water outlet, which, in turn, is sensed by a flow switch 94 interconnected with the ignition board for igniting the burner 44 and heating water to a selected temperature at which the temperature freeze switch closes the solenoid valve.

As further safety feature, a temperature modulating switch 98 may be disposed in the outlet hot water line 36 and is interconnected with the ignition board and the solenoid valves 54 to control the burner operation to a lower of the two BTU levels at a selected water temperature, for example 45° C. At this temperature, the burner at a lower BTU provided reduced water heating to maintain a desirable output water temperature in the hot water outlet 38 and faucet 102.

Finally, a temperature limit switch 106 is provided in the hot water outlet line and interconnected with the ignition board 74 for shutting down of the burner 44 at a selected high temperature, typically about 50° C.

In operation, whenever a user opens the faucet 102, the water flow activates the "flow switch" 94 which, in turn, activates the "ignition relay" 66 that applies power to the system. The minimum flow required to activate the "flow switch" is 20 oz/min (0.16 gal/min=0.6 L/min). Under normal conditions, the time delay switch 68 and the temperature limit switch 106 are closed and the power is applied to:

(a) The blower motor 62 that starts the combustion/exhaust air flow (b) The ignition board 74 that initiates the direct spark ignition sequence, and (c) The dual solenoid valve which opens to the High BTU position.

During the ignition sequence, the ignition board 74:

(a) Waits a few seconds to clear the combustion chamber of any accidental gas accumulation (b) Opens the solenoid valves 54 to establish the proper LP Gas flow to the burner 44

(c) Attempts to light by sparking the igniter 76 in a rapid sequence (d) Starts detecting the flame by verifying that the electrical resistance between the igniter tip and the burner is lowered by the ability of the flame to conduct electricity (e) It closes the solenoid valves 54 if no flame is detected within a preset time limit (typically 4 seconds).

(f) It repeats two more times steps (a) through (d) and, if no flame is detected after the third attempt the system shuts down and will not restart power is shut off (lock out condition).

After a successful ignition, the system will immediately start supplying hot water. When the user shuts off the faucet 102 the water flow stops and the power to the Ignition Board 74 is cut off; this, in turn, causes the solenoid valves 54 (and the gas flow) to shut off as well. If flame is lost for any reason, the ignition board 74 will sense the loss and will shut off the gas within (typically) 2 seconds.

Operation

During normal operation, the output temperature depends on input water temperature and the water flow established by the user. At normal (less than 60 F) the output water temperature starts increasing significantly whenever the flow is reduced to below 1 gal/min. This is not unusual in an RV where the water supply may be small when "dry camping" using a storage tank. If the temperature exceeds 120 F the t-mod switch 98 opens; this causes the dual BTU valve to reduce the gas flow and the water temperature decreases.

If for any reason the output water temperature exceeds 140 F the temperature limit switch 106 will open will cut the power to the ignition board 74 and the flame will shut off.

During normal operation, the exhaust envelope heats up and the time delay switch 68 (that is normally open) will close. When the water flow stops and power is shut off to the system, the blower 60 will continue to be powered through the blower relay until the t-delay switch opens close to room temperature.

Although there has been hereinabove described a specific low cost tankless water heater for recreational vehicles in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A portable tankless water heater comprising:

a sealed housing having an air inlet and a flue outlet;

a heat exchanger disposed in said sealed housing with an inlet cold water line and an outlet hot water line extending outside said sealed housing;

burner apparatus including a burner, disposed in an operative relationship with said heat exchanger, for heating water flowing through said heat exchanger;

a gas line extending outside of said sealed housing and in communication with said burner apparatus, an exhaust system including a blower for inducing draft of air from said air inlet through said heat exchanger and out of said flue outlet;

an ignition board for operating said burner apparatus and blower;

an anti-freezing thermostat switch disposed in said outlet hot water line and a solenoid valve connected to both of the said anti-freezing thermostat switch and said outlet hot water for drawing water from said outlet hot water line upon receipt of a signal from said anti-freezing thermostat switch, said solenoid valve being disposed outside of said housing.

2. The heater according to claim 1 wherein said burner apparatus further comprises a regulator interconnected with said ignition board and a dual solenoid valve for enabling said burner to operate at two BTU levels.

3. The heater according to claim 2 further comprising a temperature modulation switch disposed in said outlet hot water line and interconnected with said ignition board and said dual solenoid valve to control said burner to operate at a lower of the two BTU levels of a selected water temperature.

4. The heater according to claim 3 further comprising a temperature limit switch disposed in said outlet hot water level and interconnected with said ignition board for shutting of said burner at a selected high temperature.

5. The heater according to claim 1 further comprises a sensor disposed exterior to said heat exchanger and interconnected with said ignition board for determining blockage of draft air through detection of flames outside of a heat exchanger envelope, said ignition board being configured for stopping said burner upon determination of draft air blockage.

6. A portable tankless water heater comprising:

a heat exchanger heaving an inlet cold water line and an outlet hot water line;

burner apparatus, including a burner, disposed in an operative relationship with said heat exchanger, for heating water flowing through said heat exchanger;

an exhaust system including a blower apparatus for inducing draft of air from an air inlet, through said heat exchanger and out of a flue outlet;

an ignition board for operating said burner and said blower; and a sealed housing suitable for mounting in a vehicle, enclosing said heat exchanger, burner apparatus, blower apparatus, and ignition board, and providing the air inlet and the flue outlet;

an anti-freezing thermostat switch disposed in said outlet hot water line; and a solenoid valve connected to both of the said anti-freezing thermostat switch and said outlet hot water for drawing water from said outlet hot water line upon receipt of a signal from said anti-freezing thermostat switch, said solenoid valve being disposed outside of said housing.

7. The heater according to claim 6 wherein said burner apparatus further comprises a regulator interconnected with said ignition board and a dual solenoid valve for enabling said burner to operate at two BTU levels.

8. The heater according to claim 6 further comprises a sensor disposed exterior to said heat exchanger and interconnected with said ignition board for determining blockage of draft air through detection of flames outside of a heat exchanger envelope, said ignition board being configured for stopping said burner upon determination of draft air blockage.

9. The heater according to claim 7 further comprising a temperature modulation switch disposed in said outlet hot water line and interconnected with said ignition board and said dual solenoid valve to control said burner to operate at a lower of the two BTU levels of a selected water temperature.

10. The heater according to claim 9 further comprising a temperature limit switch disposed in said outlet hot water level and interconnected with said ignition board for shutting of said burner at a selected high temperature.

* * * * *